US007448299B1

(12) United States Patent
Chen

(10) Patent No.: US 7,448,299 B1
(45) Date of Patent: Nov. 11, 2008

(54) HAND TOOL WITH VIBRATION-DAMPING SLEEVE

(76) Inventor: Yung-Shou Chen, 2F-1, No. 51, Sec. 3, Chung Yang Rd., Chung Ho Tsuen, Long-Ching Town, Taichung Hsien (TW)

( * ) Notice: Subject to any disclaimer, the term of this patent is extended or adjusted under 35 U.S.C. 154(b) by 0 days.

(21) Appl. No.: 12/105,224

(22) Filed: Apr. 17, 2008

(51) Int. Cl.
*B25D 1/12* (2006.01)

(52) U.S. Cl. ..... 81/22

(58) Field of Classification Search ..... 81/22, 81/20, 489; 403/265, 266, 268
See application file for complete search history.

(56) References Cited

U.S. PATENT DOCUMENTS 2,067,751 A * 1/1937 Beegle ..... 403/227
2,702,060 A * 2/1955 Bonnesen ..... 81/22
2,850,331 A * 9/1958 Curry et al. ..... 403/179
2,917,349 A * 12/1959 Saylor et al. ..... 403/263
4,188,703 A * 2/1980 Fish ..... 29/460
4,287,640 A * 9/1981 Keathley ..... 16/110.1
5,992,270 A * 11/1999 Hedelin et al. ..... 81/22
6,128,977 A * 10/2000 Gierer et al. ..... 81/22
6,158,307 A * 12/2000 Lamond et al. ..... 81/22

* cited by examiner

*Primary Examiner*—David B Thomas
(74) *Attorney, Agent, or Firm*—Pai Patent & Trademark Law Firm; Chao-Chang David Pai

(57) ABSTRACT

A hand tool with vibration-damping sleeve is provided. The vibration-damping sleeve is set between a hammering body and a handle of the tool to buffer the hand tool from vibrating. The vibration-damping sleeve is wrapped around and joined with the handle of the hand tool by injection molding and is set in the through hole of the hammering body. Thus, the vibration-damping sleeve is tightly connected to the hammering body, thereby blocking the vibration transmission at hammering. The sleeve is made of a hard PP plastic slightly in the form of an awl, one end of which is sealed and the other end is open; the front exterior wall is divided into upper and lower caves and two convex sides.

6 Claims, 6 Drawing Sheets

HAND TOOL WITH VIBRATION-DAMPING SLEEVE

BACKGROUND OF THE INVENTION (a) Field of the Invention

This invention relates to a hand tool that is able to function with reduced transmission of vibration and particularly to a hand tool, in which a vibration-damping sleeve is disposed between a hammering body and a handle of the tool to buffer the tool from vibrating.

(b) Description of the Prior Art

A conventional hammering hand tool, such as a hammer, an axe, a shovel or the like, is mainly formed with a handle and a hammering body, in which the handle is inserted into a through hole of the hammering body. The hammering body may be provided in various forms depending on its function (s); for example, the hammering body may be in the form of a hammerhead, an axe-head, or a shovel-head. When used to hammer, the conventional hammering tool causes a counter-force which will make the hand tool vibrate. If the vibration applied by the hand tool is not reduced, a user can easily be numbed with the vibration transmitted to the handle and his or her hand can even be injured.

In order to improve the conventional hammering hand tool with respect to the vibration, a colloidal knob sleeve is generally put around a grasped portion of the handle of the hand tool to reduce the vibration caused by the hammering body and imparts a preferable non-slip effect. The knob sleeve of handle is also further improved in various ways; for example, an air chamber is formed in the sleeve to absorb the force of vibration and reduce the transmission of vibration. However, the counterforce caused by the hand tool when hammering is mostly transmitted to the knob sleeve and applied to the user's hand. Therefore, the effect of vibration absorption is still rather limited.

Consequently, in view of the technical defects described above, the applicant has through much experience and research developed the present invention, which can effectively eliminate the defects described above.

SUMMARY OF THE INVENTION

This invention is mainly to provide a hand tool that is able to function with reduced transmission of hammering vibration, in which a vibration-damping sleeve is disposed between a hammering body and a handle of the tool to buffer the hand tool from vibrating and to ease a user from being numbed by the vibration.

This invention further provides that such a hand tool has a handle which is combined with the vibration-damping sleeve by injection molding and the combined handle-sleeve is inserted into a through hole of the hammering body for secure assembly.

This invention further provides that the vibration-damping sleeve is made of a hard PP plastic substantially in the shape of an awl. One end of the sleeve is sealed and the other end is open; the exterior wall of a front end is divided into an upper cave, a lower cave opposite to the upper cave, and two convex sides. The vibration-damping sleeve is tightly wrapped around the handle of the hammering hand tool.

DETAILED DESCRIPTION OF THE PREFERRED EMBODIMENTS

Now, the present invention will be described more specifically with reference to the following embodiments. It is to be noted that the following description of preferred embodiments of this invention are presented herein for purpose of illustration and explanation only; it is not intended to be exhaustive or to be limited as to the precise form disclosed.

Figure 1:
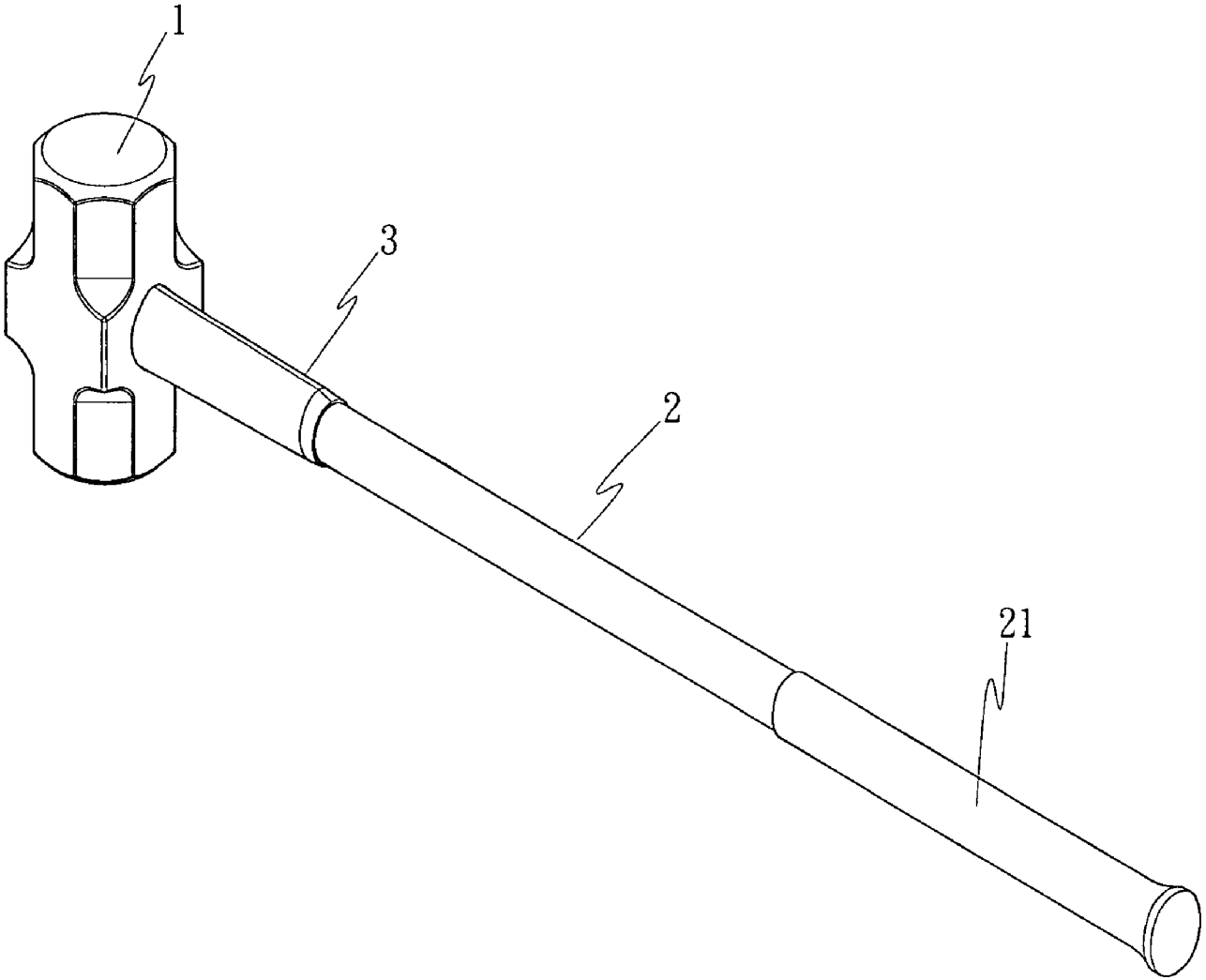
FIG. 1 is a 3 D assembly view of a hand tool according to this invention.
Figure 2:
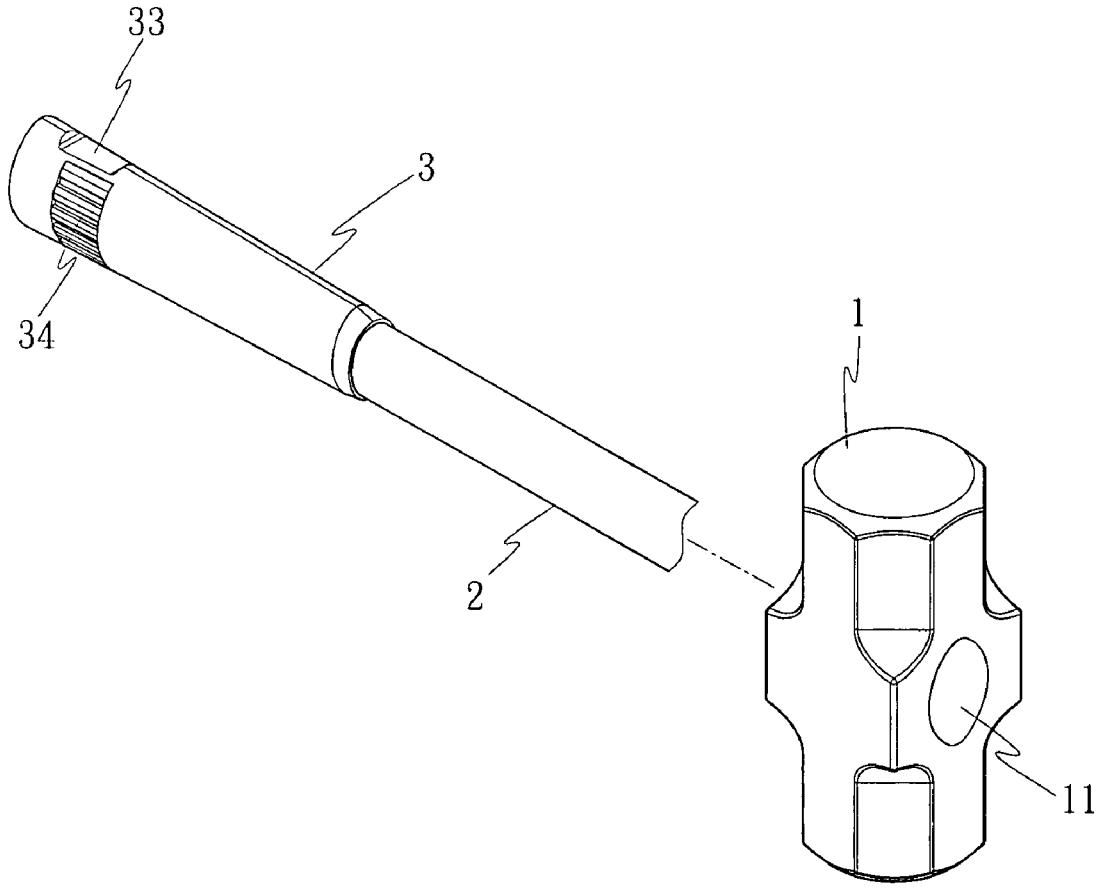
FIG. 2 is a 3 D exploded view of the hand tool shown in FIG. 1.
Figure 3:
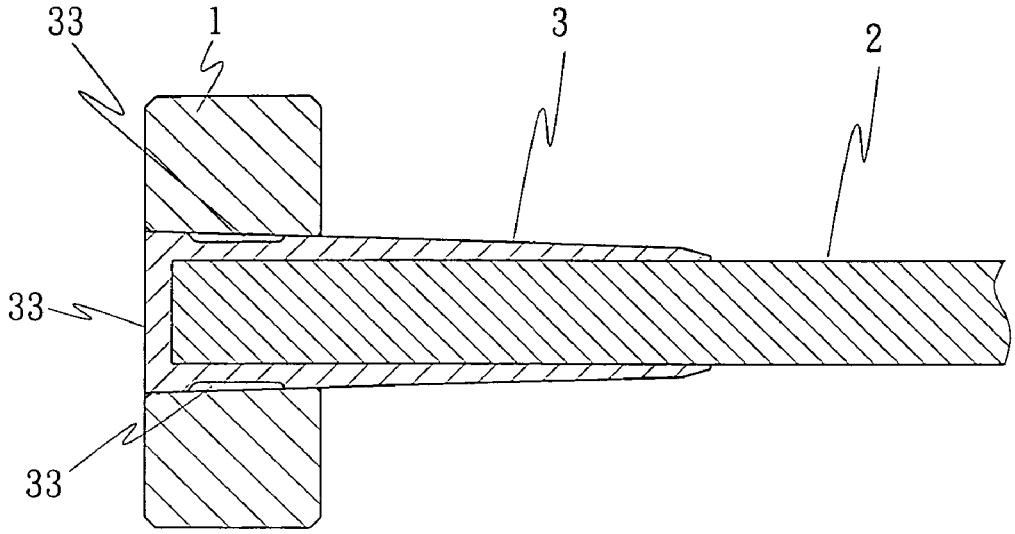
FIG. 3 is a sectional view of the hand tool shown in FIG. 1.
Figure 4:
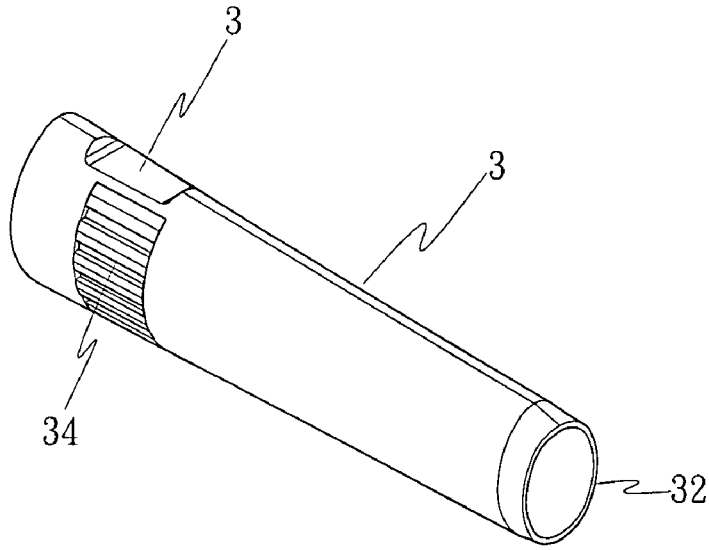
FIG. 4 is a 3 D view of a vibration-damping sleeve of a hand tool according to this invention.
Figure 5:
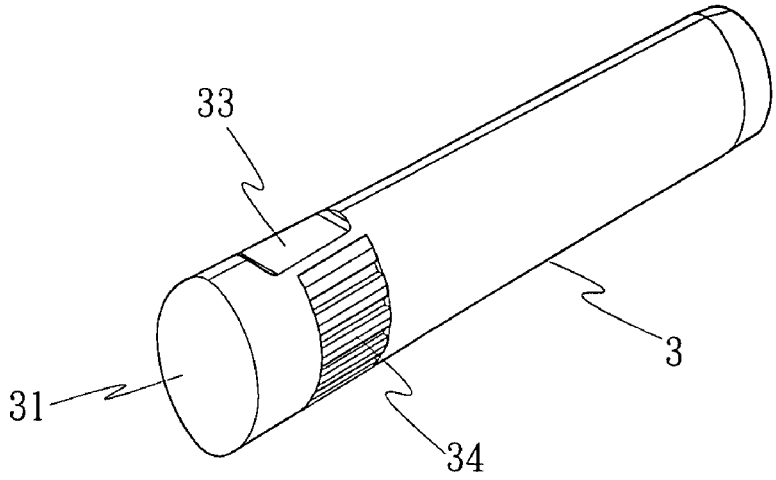
FIG. 5 is a 3 D view of the vibration-damping sleeve according to this invention as viewed from another angle.
Figure 6:
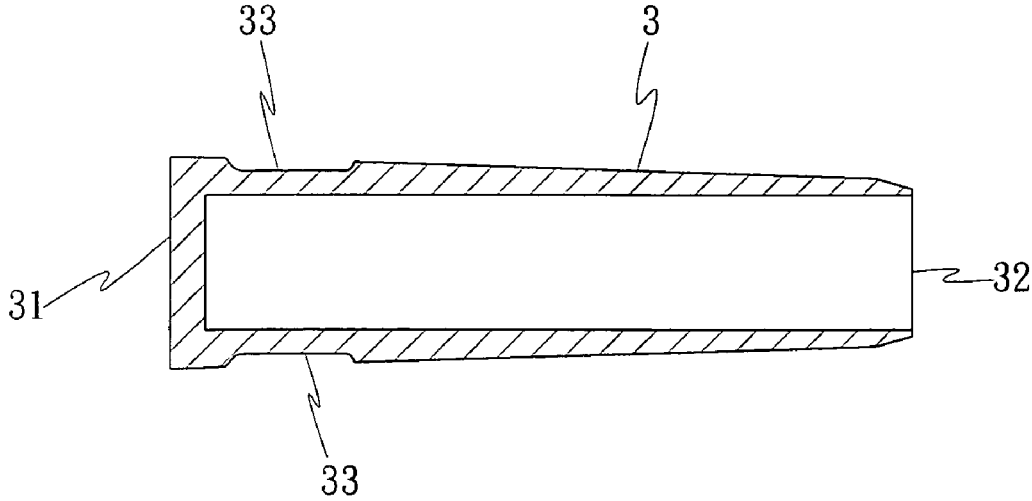
FIG. 6 is a sectional view of the vibration-damping sleeve shown in FIG. 4.
Figure 7:
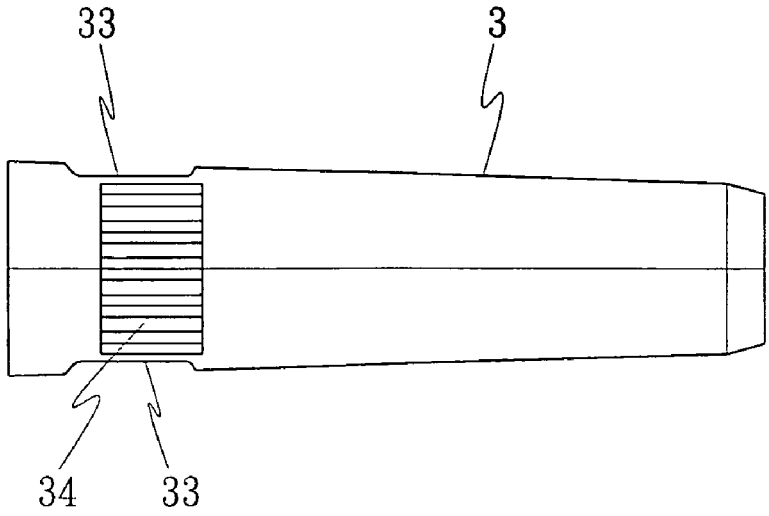
FIG. 7 is a side view of the vibration-damping sleeve according to this invention.
Figure 8:
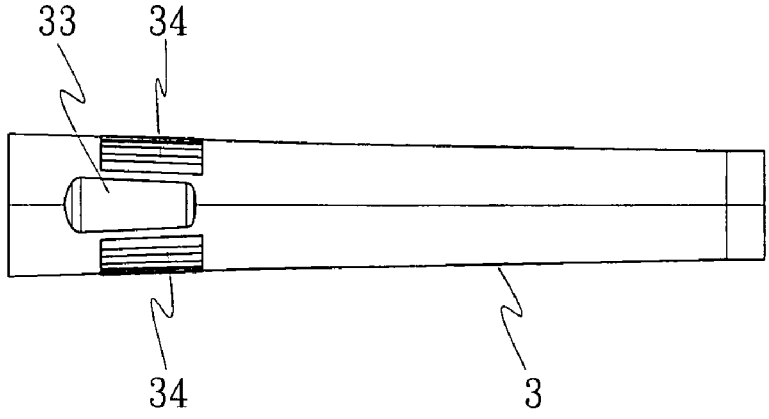
FIG. 8 is a top view of the vibration-damping sleeve according to this invention.

With reference to FIG. 1 through FIG. 3, a hand tool that is able to reduce the transmission of vibration according to this invention may be a hammering hand tool in various forms, such as a hammer or any of various hammering hand tools. In general, the hammering hand tool comprises a hammering body 1, a handle 2, and a vibration-damping sleeve 3.

Figure 9:
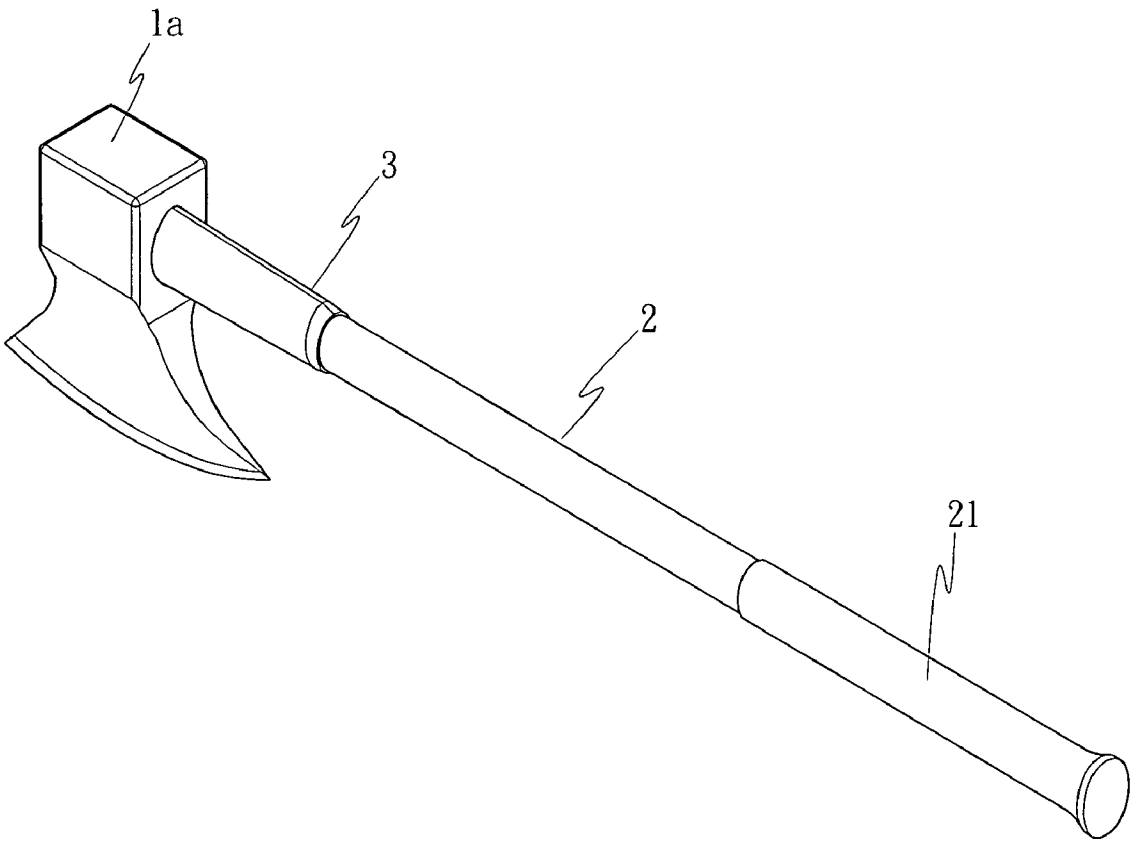
FIG. 9 is a 3 D assembly view of this invention as embodied in a hand-held axe.

The hammering body 1 that is in the form of a hammering hand tool is provided for various functions. Thus, the hammering body 1 may be changed according to the service function, and is not limited to any particular form; for example, the hammering body 1 may be in the form of a hammerhead, as shown in FIG. 1 through FIG. 3, or in the form of an axe-head, as shown in FIG. 9. Further, the hammering body 1 is provided with a through hole 11 by default.

The handle 2 is a long rod for a user to hold and is not limited to any particular material. A colloidal non-slip knob sleeve 21 is generally put around the tail of the handle for the hold to hold easily without slipping.

The vibration-damping sleeve 3 is put around an end of the handle 2 of hand tool, and may be made of a hard PP plastic (polypropylene) capable of resisting impact, and wrapped around the end of the handle 2 by injection molding. With reference to FIG. 4 through FIG. 8, the body of vibration-damping sleeve 3 is roughly in the shape of an awl, one end of which is a sealed end 31 and the other end of which is an open end 32, in which the diameter of the sealed end 31 is slightly larger than that of unsealed end 32; the exterior wall of a front end is provided with upper and lower caves 33 that are opposite to each other and two convex sides 34 opposite to each other.

The vibration-damping sleeve 3 is fixed to one end of the handle 2 and the other end of the handle 2 is made to pass through the through hole 11 of the hammering body 1 so that the two convex sides of the vibration-damping sleeve 3 are tightly connected with the hammering body 1 to buffer the hand tool from vibrating and to ease the user from being numbed by the vibration.

With reference to FIG. 3, the front end of the vibration-damping sleeve 3 is tightly in contact with the through hole 11 of the hammering body 1. The through hole 11 may also be a taper hole. The upper and lower caves 33 that are opposite to each other are positioned respectively at two inner walls of the through hole 11, and the two convex sides 34 opposite to each other are tightly oriented to the walls of the through hole 11 so that the vibration-damping sleeve 3 may be very securely wedged into the through hole 11 of the hammering body 1; thus, the upper and lower caves 34 of the vibration-damping sleeve 1 are used to effectively buffer the hammering hand tool body 1 from vibrating and reduce the transmission of vibration and to further reduce the vibration caused by the tail of the handle 2 for preventing the user from injuring his or her hand due to the direct transmission of vibration.

In an embodiment, the two convex sides 34 of the vibration-damping sleeve 3 may be provided with a plurality of teeth or strips that are alternately concave and convex to enhance the tightness between the vibration-damping sleeve 3 and the hammering body 1.

With reference to FIG. 9, the vibration-damping sleeve 3 according to this invention may be applied to a hammering hand tool 1*a* in the form of axe to likewise reduce the transmission of vibration caused by the hammering body 1*a* in the form of axe-head. Similarly, the vibration-damping sleeve 3 may be widely applied in various other tools.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A hand tool comprising a hammering body, a handle, and a vibration-damping sleeve, wherein the hammering body is provided with a through hole;

the handle is a long rod;

the vibration-damping sleeve is a hollow tube substantially in the form of an awl, one end of which is sealed and the other end is open, in which the diameter of the sealed end is larger than that of the open end and an exterior wall near the sealed end is provided with an upper cave, a lower cave opposite to the upper cave, and two convex sides opposite to each other;

a first end of the handle is inserted into the vibration-damping sleeve through the open end of the vibration-damping sleeve;

and a second end of the handle opposite to the first end is made to pass through the through hole of the hammering body so that the two convex sides of the vibration-damping sleeve are tightly connected with the hammering body and the upper and the lower caves are positioned respectively at two inner walls of the through hole to buffer the hand tool from vibrating.

2. The hand tool according to claim 1, wherein the hammering body is a hammerhead.

3. The hand tool according to claim 1, wherein a non-slip knob sleeve is disposed around the second end of the handle.

4. The hand tool according to claim 1, wherein the vibration-damping sleeve is made of a hard PP plastic (polypropylene) and is wrapped around the first end of the handle by injection molding.

5. The hand tool according to claim 1, wherein the through hole of the hammering body is a taper hole that matches with the vibration-damping sleeve.

6. The hand tool according to claim 1, wherein a plurality of teeth or strips that are alternately concave and convex are formed at the two convex sides of the vibration-damping sleeve.

* * * * *